US005378322A

United States Patent [19]

Hornsey

[11] Patent Number: 5,378,322

[45] Date of Patent: Jan. 3, 1995

[54] CARBON DIOXIDE IN NEUTRAL AND ALKALINE SIZING PROCESSES

[75] Inventor: Derek Hornsey, Beaconsfield, Canada

[73] Assignee: Canadian Liquid Air Ltd./Air Liquide Canada LTEE., Montreal, Canada

[21] Appl. No.: 64,374

[22] Filed: May 21, 1993

[30] Foreign Application Priority Data

May 27, 1992 [CA] Canada ..... 2069713-0

[51] Int. Cl.[6] ..... D21H 21/16

[52] U.S. Cl. ..... 162/158; 162/179; 162/181.2; 162/181.4; 162/183

[58] Field of Search ..... 162/158, 179, 183, 101, 162/181.2, 181.1, 18.4

[56] References Cited

U.S. PATENT DOCUMENTS

| | | | |
|---|---|---|---|
| 1,878,047 | 9/1932 | Wenger | 162/101 |
| 5,114,538 | 5/1992 | Malatesta | 162/158 |
| 5,122,230 | 6/1992 | Nakajima | 162/181.2 |

FOREIGN PATENT DOCUMENTS

| | | | |
|---|---|---|---|
| 0572304 | 12/1993 | European Pat. Off. . | |
| 62-162098 | 7/1987 | Japan | 162/181.2 |
| 2252984 | 8/1992 | United Kingdom . | |
| 235541 | 6/1969 | U.S.S.R. | 162/158 |

OTHER PUBLICATIONS

Abstract Bulletin of the Institute of Paper Chemistry, vol. 54, No. 4, Oct. 1983, p. 426, Kamutzi, et al., "Mechanisms of Neural Sizing with Alkyl Diketenes".

*Primary Examiner*—Peter Chin

*Attorney, Agent, or Firm*—Oblon, Spivak, McClelland, Maier & Neustadt

[57] ABSTRACT

In the non-acidic sizing of paper reaction between alkylketene dimer sizing agent and cellulose of cellulosic paper-making fibers is catalyzed by dissolving carbon dioxide in an aqueous vehicle of an aqueous pulp of the paper-making fibers; the carbon dioxide provides bicarbonate ions which catalyse the reaction; the bicarbonate ions may be generated by dissociation of the carbon dioxide in water, or by reaction of the carbon dioxide with calcium carbonate incorporated in the pulp as a filler for the paper, or with some other alkali present.

5 Claims, 3 Drawing Sheets

CARBON DIOXIDE IN NEUTRAL AND ALKALINE SIZING PROCESSES

BACKGROUND OF THE INVENTION

1. Field of the Invention

This invention relates to the sizing of paper.

2. Description of the Background

Sizing in the paper industry is a process whereby a material is incorporated into the paper to render the paper more resistant to penetration by liquids, especially water.

The size may be added to the stock of the aqueous pulp use to form the paper or the formed dry paper may be passed through a solution of the size.

In North America the most popular sizing processes used acid materials and operate at an acidic pH of 4 to 5.

Sizing processes which operate in a non-acidic pH range of 7 to 8 account for about 25% of the paper and paperboard market.

A particular advantage of neutral or alkaline sizing in papermaking, is that calcium carbonate can be used as filler in place of the more expensive titanium dioxide and clay fillers used in acidic sizing. In 1992 the cost of calcium carbonate filler is about 10% that of titanium dioxide filler and about 65% that of clay filler.

A further advantage in employing calcium carbonate filler is that calcium carbonate in the paper is a source of alkalinity which provides resistance to acidic ambient conditions, and this provides longer shelf life. Furthermore, non-acidic sizing causes less corrosion in the paper machines.

In the neutral or alkaline sizing process where alkylketene dimers are employed as sizing agents, the reaction between alkylketene dimer and cellulose proceeds at a slow rate.

SUMMARY OF THE INVENTION

It has now been found that injection of carbon dioxide into an aqueous vehicle of an aqueous pulp of cellulosic paper-forming fibers can be employed to provide bicarbonate ion to catalyse the reaction between cellulose and alkylketene dimers.

BRIEF DESCRIPTION OF THE DRAWINGS

Carbon dioxide dissociates weakly when dissolved in water in accordance with equation (I):

$$CO_2+H_2O \rightarrow H^+ + HCO_3^- \quad (I)$$

There is further dissociation in accordance with equation (2):

$$HCO_3^- \rightarrow H^+ + CO_3^{2-} \quad (2)$$

but this dissociation is much weaker than that of equation (I).

It is found that, when dissolved in the aqueous vehicle of the aqueous pulp, carbon dioxide provides sufficient bicarbonate ion to catalyse the reaction between the alkylketene dimers and cellulose of the cellulosic fibers.

Further alkaline material present in the aqueous vehicle will react with dissolved carbon dioxide, for example, calcium carbonate will react with carbon dioxide to form calcium bicarbonate, or caustic soda will react with carbon dioxide to form sodium bicarbonate which in aqueous solution will dissociate to provide the desired catalytic bicarbonate ions.

Thus a portion of the calcium carbonate added as filler will react with injected carbon dioxide to form the catalytic bicarbonate ions. This occurs down to a pH of about 8.6. At lower pH, carbon dioxide addition results in dissolution and ionization to bicarbonate ion and further lowering of the pH.

Suitably the carbon dioxide is injected by diffusion of the carbon dioxide gas into the aqueous vehicle, as fine gas bubbles.

The carbon dioxide gas may be added to the stock preparation tank or to a liquid stream entering the stock preparation tank, for example, a recycle stream to the tank.

Suitably the carbon dioxide is injected into the aqueous vehicle under conditions of turbulent mixing to dissolve the carbon dioxide in the aqueous vehicle.

Figure 1:
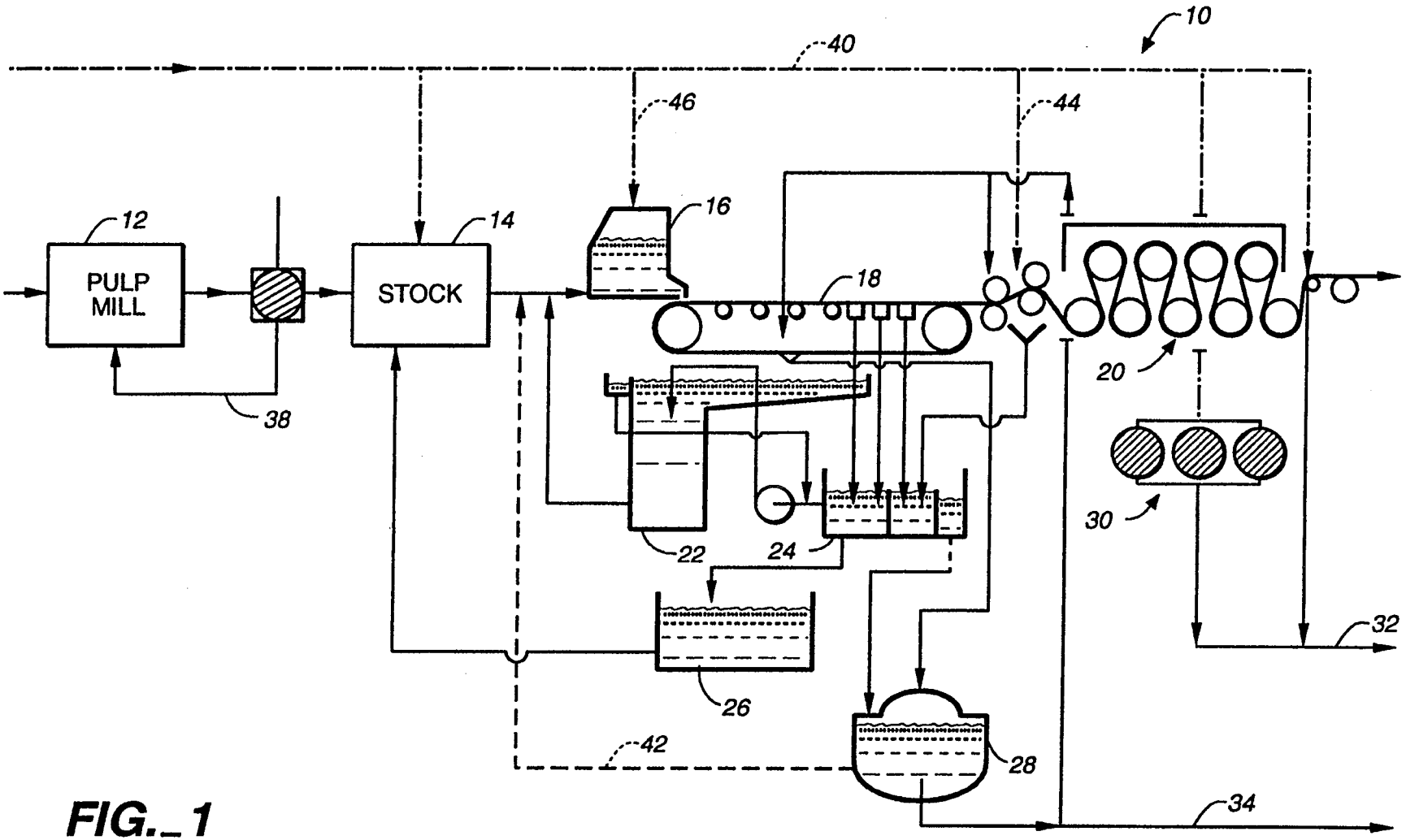

Figure 1 illustrates schematically a conventional white water system in paper manufacture.

Figure 2:
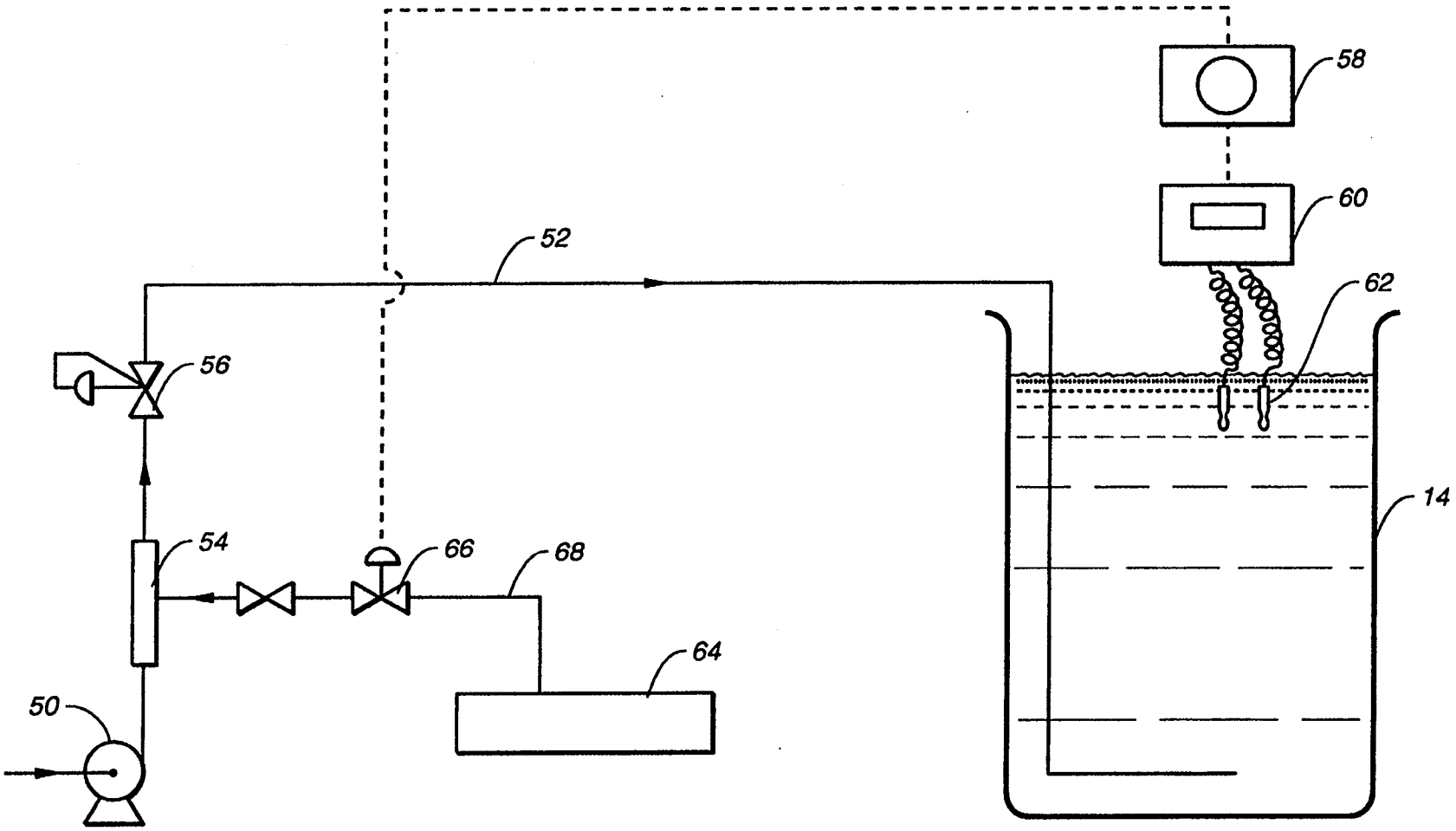

Figure 2 illustrates schematically a diffusion system for injection of carbon dioxide into an aqueous vehicle of an aqueous pulp.

Figure 3:
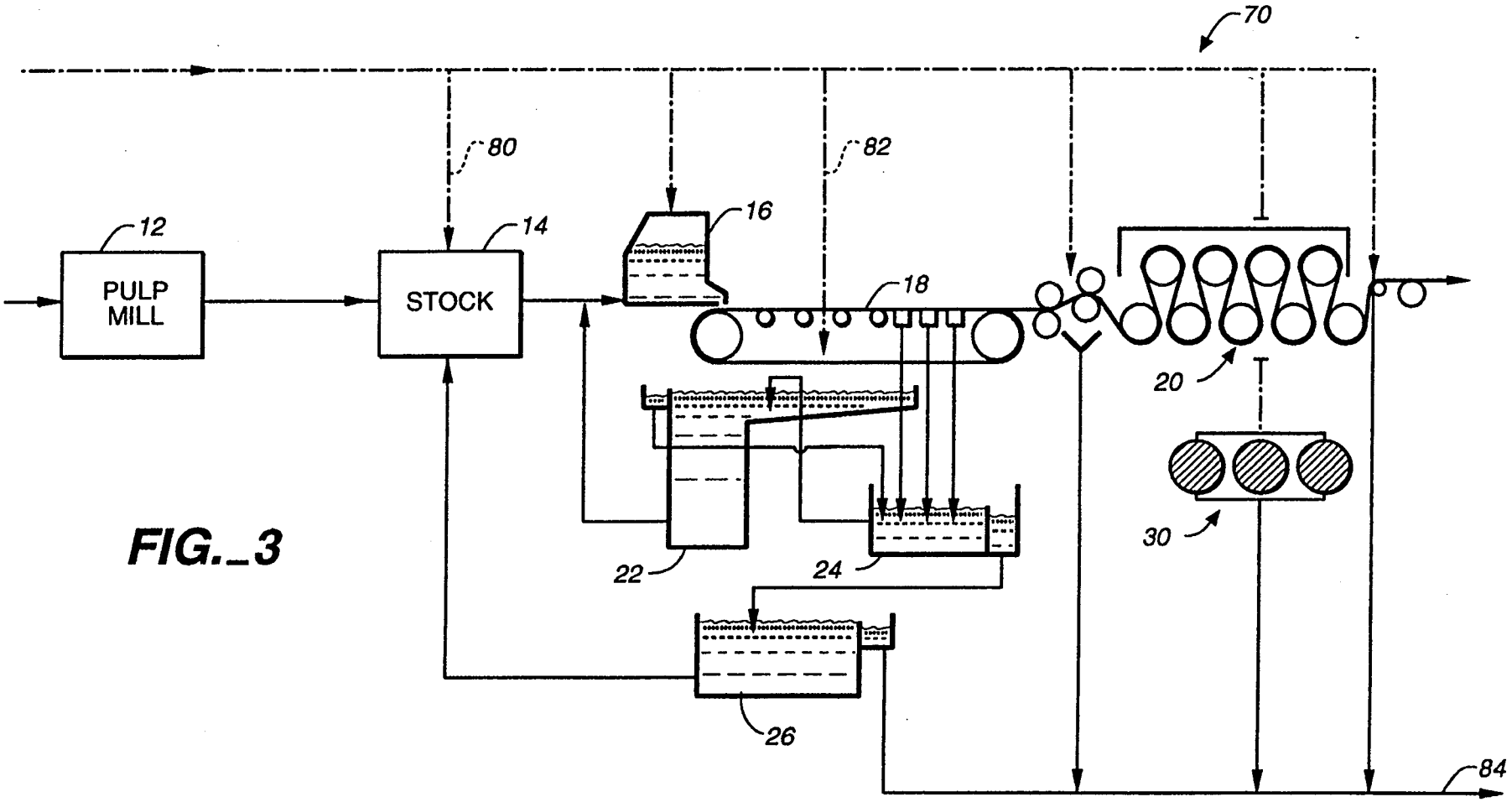

Figure 3 illustrates schematically a closed white water system.

DETAILED DESCRIPTION OF THE PREFERRED EMBODIMENTS

With further reference to FIG. 1, the white water system 10 includes a pulp mill 12, a stock tank 14, a feed tank 16, a paper-forming screen 18 and calendar rolls 20 for the production of paper.

System 10 further includes a wire pit 22, seal pit 24 and white water chest 26.

Still further, system 10 includes a fiber recovery unit 28 and a vacuum system 30 associated with calendar rolls 20.

A fiber-free effluent line 32 communicates with vacuum system 30 and the downstream end of calendar rolls 20; and a low fiber effluent line 34 communicates with fiber recovery unit 28 and the upstream end of calendar rolls 20.

A press 36 is connected between pulp mill 12 and stock tank 14 and a pulp dilution line 38 communicates press 36 and pulp mill 12.

Finally system 10 includes fresh water line 40, a recovered fiber line 42, a shower water line 44 and a sealing water line 46.

System 10 is a traditional white water system the specifics and operation of which are known to persons in the art, and are not a subject of the present invention.

In general the aqueous pulp formation of the paper is formed in stock tank 14 employing pulp from the pulp mill 12. The pulp is pressed in press 36 and water from the press is recycled along line 38 to pulp mill 12.

The prepared aqueous pulp is fed from stock tank 14 to feed tank 16 and from there on to paper-forming screen 18 on which a fiber mat is formed which is fed to the calendar rolls 20 for formation of the paper.

Water from paper-forming screen is fed to the seal pit 24 and fiber recovery unit 28. The portion of the water in seal pit 24 is fed to wire pit 22 and from there recycled into feed tank 16. A further portion of the water in seal pit 24 is fed to white water chest 26 and from there is recycled to stock tank 14.

A further portion of the water in wire pit 22, containing settled fibers, is fed to fiber recovery unit 28 together with a fiber containing effluent from the upstream end of paper-forming screen 18, and from unit 28 recovered fibers are fed back to feed tank 16 and a low fiber effluent is removed through line 34.

Residual water and moisture is removed from the paper at calendar rolls 20 by vacuum system 30 and a fiber free effluent is removed through line 32.

Fresh water to meet the needs of the system 10 is fed through line 40, with feeds from line 40 through sealing water line 46 to stock tank 14 and through shower water line 44 to paper-forming screen 18 at an upstream end of paper-forming screen 18.

As shown in FIG. 1, fresh water line 40 also feeds feed tank 16 and intermediate and downstream ends of the calendar rolls 20.

With further reference to FIG. 3, a closed white water system 70 contains elements common with traditional white water system 10 of FIG. 1.

In view of this the same integers are employed in FIG. 3 for components which correspond to those of FIG. 1.

System 70 differs from system 10 in that a shower water line 80 feeds stock tank 14 and a sealing water line 82 feeds paper-forming screen 18. Additionally, a high fiber effluent line 84 removes high fiber effluent from white water chest 26, vacuum system 30 and the upstream and downstream ends of calendar rolls 20. The system 70 does not include the fiber recovery unit 28.

With further reference to FIG. 2, there is shown schematically a system for dissolution of carbon dioxide in the aqueous pulp of the system 10 of FIG. 1 or the system 70 of FIG. 3.

The stock tank 14 of FIGS. 1 and 3 is shown in FIG. 2.

As shown in FIG. 2, pump 50 feeds pulp from pulp mill 12 (not shown) as a flowing stream along feed line 52 to stock tank 14.

Feed line 52 includes a diffuser 54 and a pressure control valve 56.

A controller 58, pH meter 60 and pH probes 62 are associated with stock tank 14.

Supply tank 64 of carbon dioxide communicates through line 68 with diffuser 54, and a control valve 66 is disposed in line 68.

In operation pulp is pumped as a flowing stream along line 52 by pump 50, into stock tank 14.

pH in stock tank 14 is monitored by pH meter 60 through pH probes 62. Controller 58 monitors the pH meter 60 and controls control valve 66 for feed of carbon dioxide gas from supply tank 64 to diffuser 54 in response to the pH in stock tank 14.

Carbon dioxide is thus introduced into the flowing pulp stream and allowed to dissolve therein while maintaining the pH in a desired non-acidic range, which typically may be 7 to 9.

In the embodiment illustrated in FIG. 2, diffuser 54 is located downstream of pump 50 and the aqueous pulp in feed line 52 is pumped by pump 50 as a flowing stream having a velocity sufficient to produce turbulent agitation or mixing of the aqueous pulp and the carbon dioxide injected by diffuser 54. The length of feed line 52 is such that under turbulent mixing conditions, a hydraulic residence time of the flowing fluid in line 52 is at least 30 seconds. In this way adequate dissolution of carbon dioxide in the flowing stream is achieved.

Where calcium carbonate is to be employed as the filler this may suitably be introduced at the pulp mill so that it forms part of a pulp slurry pumped by pump 50 along feed line 52, and in this way the carbon dioxide may react with the calcium carbonate to produce calcium bicarbonate and thus bicarbonate ions. Alternatively the calcium carbonate may be added as a subsequent stage, for example, downstream of stock tank 14, and in such case bicarbonate ions are formed in feed line 52 by dissociation of dissolved carbon dioxide in the aqueous vehicle of the aqueous pulp.

The alkylketene dimer sizing agent may be introduced at the pulp mill such that it is turbulently mixed with the cellulosic pulp in the presence of the bicarbonate ions in the feed line 52, or it may be introduced into the aqueous pulp at a subsequent stage such as in feed tank 16.

I claim:

1. A process for sizing paper, comprising:

a) forming an aqueous pulp of cellulosic paper-forming fibers and an aqueous vehicle containing an alkaline material selected from the group consisting of caustic soda and calcium carbonate, b) contacting the fibers in said aqueous pulp with an alkylketene dimer sizing agent at a non-acidic pH, and c) dissolving carbon dioxide gas in the aqueous vehicle and allowing said carbon dioxide to react with said alkaline material to provide an amount of bicarbonate ions in an amount sufficient to catalyze reaction between the alkylketene dimer sizing agent and the cellulose of the fibers.

2. The process according to claim 1, wherein said carbon dioxide is dissolved in the aqueous vehicle under a condition of turbulent mixing.

3. The process according to claim 2, wherein said carbon dioxide is introduced into a flowing stream of the aqueous pulp, said stream flowing at a liquid velocity effective to produce turbulent mixing and a hydraulic residence time of carbon dioxide in the flowing stream of at least 30 seconds.

4. The process according to claim 1, wherein said alkaline material is calcium carbonate.

5. The process according to claim 1, wherein said non-acidic pH is from about 7 to 9.

* * * * *